US007506636B2

(12) United States Patent
Lubinski et al.

(10) Patent No.: US 7,506,636 B2
(45) Date of Patent: Mar. 24, 2009

(54) CHECK VALUE PLACEMENT IN AN ELECTRONIC RETURNLESS FUEL SYSTEM

(75) Inventors: Joseph Lubinski, Livonia, MI (US); Hideto Takahashi, Kariya (JP); Tatsuya Matsumoto, Kariya (JP)

(73) Assignees: DENSO International America, Inc., Southfield, MI (US); Denso Corporation, Kariya (JP)

( * ) Notice: Subject to any disclaimer, the term of this patent is extended or adjusted under 35 U.S.C. 154(b) by 155 days.

(21) Appl. No.: 11/703,046

(22) Filed: Feb. 6, 2007

(65) Prior Publication Data

US 2008/0184971 A1 Aug. 7, 2008

(51) Int. Cl.
*F02M 37/04* (2006.01)
*F02M 37/08* (2006.01)

(52) U.S. Cl. ..... 123/509; 123/511

(58) Field of Classification Search ..... 123/509, 123/510, 511, 514, 457, 459, 497, 468, 469; 137/574, 571

See application file for complete search history.

(56) References Cited

U.S. PATENT DOCUMENTS

| | | | | |
|---|---|---|---|---|
| 5,195,494 | A * | 3/1993 | Tuckey | 123/514 |
| 5,392,750 | A * | 2/1995 | Laue et al. | 123/509 |
| 2001/0004889 | A1 * | 6/2001 | Schreckenberger | 123/457 |
| 2002/0043253 | A1 * | 4/2002 | Begley et al. | 123/457 |

* cited by examiner

*Primary Examiner*—Mahmoud Gimie
(74) *Attorney, Agent, or Firm*—Harness, Dickey & Pierce, PLC

(57) ABSTRACT

A fuel pump module within a fuel tank employs at least one fuel pump, while in the case of additional fuel pumps, a manifold receives all pumped fuel and directs it into a surrounding fuel filter within a filter case. A check valve is adjacent the filter case at a first location and a pressure regulator is adjacent the check valve. With the check valve located between the filter case and the pressure regulator, high fuel pressures may be maintained in the engine supply line when the engine is shut off, while during engine operation the pressure regulator may relieve excessive fuel pressure and deliver fuel to the engine through an engine supply line. A jet pump supply line exits the filter case at a second case location and supplies fuel to one or more jet pumps, such as a fuel pump module reservoir jet pump.

15 Claims, 4 Drawing Sheets

CHECK VALUE PLACEMENT IN AN ELECTRONIC RETURNLESS FUEL SYSTEM

FIELD

The present disclosure relates to placement of a check valve and a pressure regulator in a fuel pump module of an electronic returnless fuel system.

BACKGROUND

The statements in this section merely provide background information related to the present disclosure and may not constitute prior art. Modern fuel systems in vehicles, such as automobiles, may employ an electronic returnless fuel system ("ERFS") to deliver fuel to an engine. Regarding such electronic returnless fuel systems, only a fuel supply line from a fuel tank to an engine is utilized; therefore, no return fuel line from the engine to the fuel tank is necessary. As a result of such a configuration, in an ERFS only the exact volume of fuel required by an engine is delivered to the engine, regardless of the varying degree of the volume of fuel required by the engine.

While current electronic returnless fuel systems have generally proven to be satisfactory for their applications, each is associated with its share of limitations. One limitation of current ERFS is their inability to supply liquid fuel to an engine in a volume and at a pressure that meets or exceeds engine demand. Another limitation is the general inability of current ERFS systems to accept more than one fuel pump within a fuel pump module while utilizing only a single check valve within the fuel pump module. Another limitation is that current ERFS fuel pump module jet pumps are not configured to operate using filtered fuel from a separate area of the fuel pump module fuel filter, and because of this limitation, jet pump interference with the pressurized fuel flowing to the engine during pump on and off conditions is possible. Still yet another limitation is that with current ERFS, because jet pumps begin functioning when the pressure regulator permits fuel to flow to the jet pumps when the fuel pressure reaches a set amount to open the regulator, during high fuel demand situations, such as wide open throttle, the fuel pressure may not permit the regulator to open and begin jet pump operation.

What is needed then is a device that does not suffer from the above limitations. This, in turn, will provide a device that utilizes a check valve between a fuel module fuel filter and a fuel pressure relief regulator.

SUMMARY

A fuel pump module within a fuel tank employs one or more fuel pumps. In the case of more than one fuel pump, a manifold receives all pumped fuel and directs it into a fuel filter that surrounds the fuel pumps and that lies within a surrounding filter case. A check valve attaches to or is integrally molded to an exterior surface of the filter case at a first filter case location while a pressure regulator attaches to or is integrally molded to the check valve. From the check valve, an engine supply line delivers fuel to an internal combustion engine. With the check valve located between the filter case and the pressure regulator, high fuel pressures may be maintained in the engine supply line when the engine is not operating, while during engine operation, the pressure regulator may still relieve excessive fuel pressure and deliver fuel to the engine. A jet pump supply line attaches to or is integrally molded into the filter case at a second filter case location and supplies fuel to one or more jet pumps, such as a fuel pump module reservoir jet pump and a fuel transfer jet pump, if a vehicle is equipped with an auxiliary fuel tank or saddle fuel tank.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
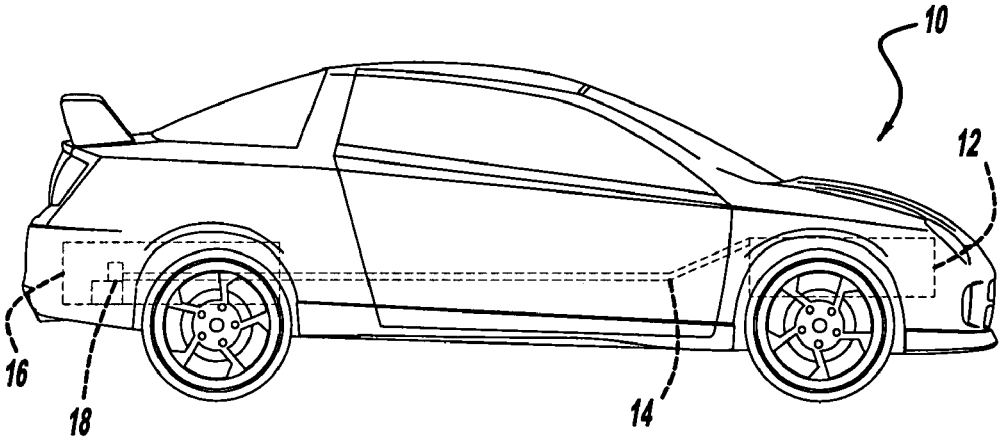
FIG. 1 is a perspective view of a vehicle depicting portions of a fuel system in phantom.

The following description is merely exemplary in nature and is not intended to limit the present disclosure, application, or uses. It should be understood that throughout the drawings, corresponding reference numerals indicate like or corresponding parts and features. With reference to FIGS. 1-6, a check valve and pressure regulator configuration within a fuel pump module of an electronic returnless fuel system ("ERFS") will be described.

Figure 2:
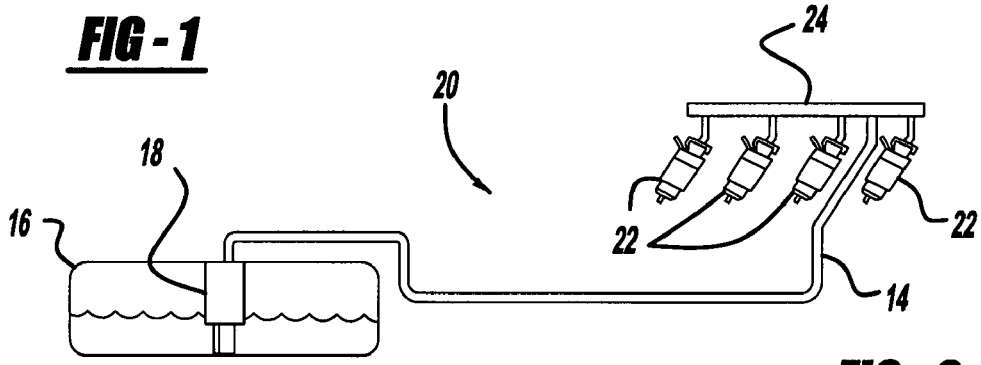
FIG. 2 is a perspective view of a vehicle fuel supply system depicting fuel injectors and a fuel pump module within a fuel tank.

FIG. 1 depicts a vehicle 10, such as an automobile, having an engine 12, a fuel supply line 14, a fuel tank 16, and a fuel pump module 18. The fuel pump module 18 fits within the fuel tank 16 and is normally submerged in or surrounded by varying volumes of liquid fuel when the fuel tank 16 possesses liquid fuel. A fuel pump within the fuel pump module 18 pumps fuel to the engine 12 through a fuel supply line 14. FIG. 2 is a general overall perspective view of a vehicle fuel supply system 20 depicting fuel injectors 22 of the engine 12 that receive fuel from a fuel injector common rail 24.

Figure 3:
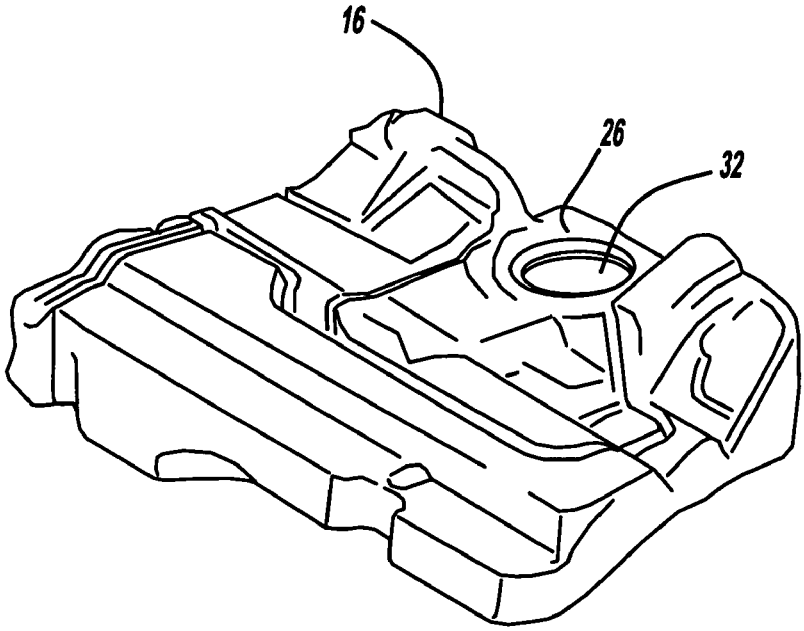
FIG. 3 is a perspective view of a vehicle fuel tank depicting a mounting location of a fuel pump module.

More specifically, in an electronic returnless fuel system ("ERFS"), only a fuel supply line 14 carries fuel between the fuel pump module 18 and the common rail 24, if a vehicle is so equipped. Once the fuel reaches the common rail 24, the fuel passes into individual fuel injectors 22 just before being sprayed or injected into individual combustion cylinders of the internal combustion engine 12. The fuel supply system 20 has no fuel return line from the common rail 24 to the fuel tank 16, as in some systems, and because there is no return line, one or more electric fuel pumps within the fuel pump module 18 has its supply voltage varied to vary the amount of fuel supplied to the common rail, as dictated by the fuel demand from the engine 12. FIG. 3 is a perspective view of a vehicle fuel tank 16 depicting a mounting location 26, such as the structure surrounding a hole 32 in the top of the tank 16, for a fuel pump module 18. Typically, the fuel pump module 18 is lowered through the top of the fuel tank 16 and secured to the top surface of the fuel tank. This and other workings of the present teachings will be elaborated on with reference to FIGS. 4-5.

Figure 4:
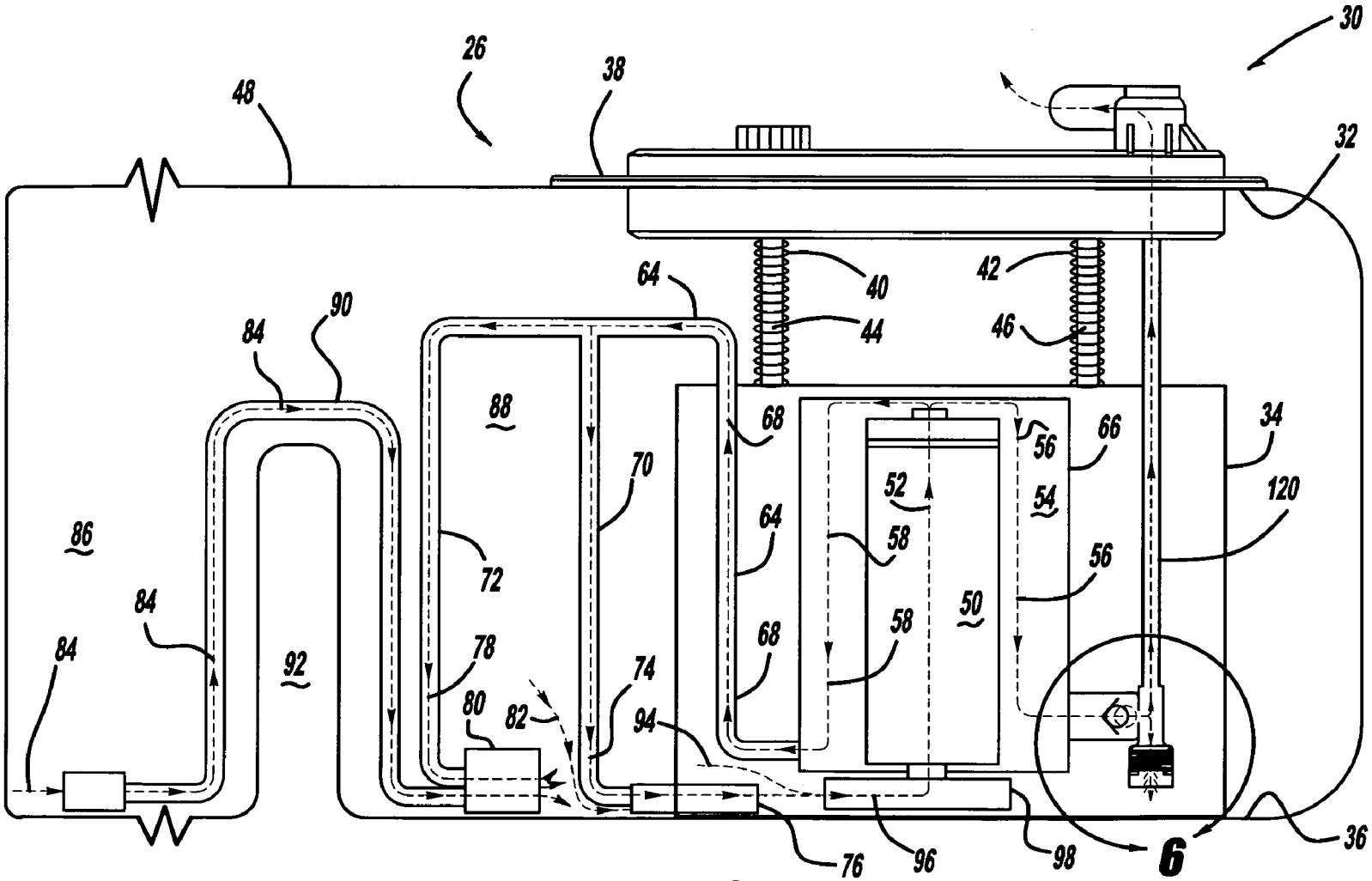
FIG. 4 is a side view of a fuel pump module residing within a fuel tank in accordance with an embodiment of the present invention.

With reference to FIG. 4, a first configuration of a fuel pump module 30 is depicted. More specifically, when the fuel pump module 30 is lowered through the hole 32 and secured to the mounting location 26, a reservoir 34 contacts the bottom surface 36 of the fuel tank 16. To secure the reservoir 34 to the bottom surface 36 of the fuel tank 16, the fuel pump module flange 38 is pressed to compress a first spring 40 on a first rod 44 and a second spring 42 on a second rod 46. Upon contact of the reservoir 34 with the bottom surface of the fuel tank 16, the biasing force of the springs 40, 42 firmly secures the reservoir 34 to the bottom of the fuel tank 16. The flange 38 is then fixed to the mounting location 26 of the top surface 48 of the fuel tank 16 to maintain the secured position.

The fuel pump module 30 of FIG. 4 may be of at least two general configurations. In a first configuration, the reservoir 34 may be elongated with its longitudinal axis projecting primarily parallel to the bottom surface 36 of the fuel tank 16 while in a second configuration, the reservoir 34 may be generally cylindrical with its longitudinal axis projecting primarily perpendicular to the bottom surface 36 of the fuel tank 16. Either configuration is suitable for the teachings of the present invention.

Continuing with FIG. 4, the fuel filter 54 may be generally cylindrical and surround the fuel pump 50 about the pump periphery. When a fuel pump 50 discharges pumped fuel, as depicted with flow arrow 52, the fuel may flow in multiple directions into a fuel filter 54 that surrounds the fuel pump 50. More specifically, when fuel exits the fuel pump 50, it is free to flow in 360 degrees about the top of the fuel pump, into the fuel filter 54. For ease of explanation in using the side view of FIG. 4, the fuel may flow through the fuel filter 54 in accordance with either a flow path 56 or a flow path 58. With the flow path 56, the fuel flows to a check valve 60 and a pressure regulator 62, while with the flow path 58, fuel flows to a jet pump feed line 64. Fuel is maintained within the fuel filter 54 by a fuel filter case 66 until it reaches an exit location, such as the check valve 60 or the jet pump feed line 64.

The jet pump feed line 64 is depicted as being attached to or integrally molded into a different location of the filter case 66 than the check valve 60, which may also be attached to or integrally molded into the filter case 66. Because the jet pump feed line 64 receives fuel directly from the filter case 66, the jet pumps, advantageously, are supplied with fuel that has passed through the filter 54, which removes any particulate matter. Upon fuel passing into and moving though the jet pump feed line 64 in accordance with flow arrows 68, it moves into either a fuel module reservoir jet pump tube 70 or a transfer jet pump tube 72. The reservoir jet pump tube 70 delivers fuel 74 to a reservoir jet pump 76, while the transfer jet pump tube 72 delivers fuel 78 to a transfer jet pump 80. The reservoir jet pump 76 receives fuel 74 with the pressure supplied by the fuel pump 50 to cause fuel 82 within the fuel tank 16 to enter the fuel pump module reservoir 34. The transfer jet pump 80 receives fuel 78 with the pressure supplied by the fuel pump 50 to cause fuel 84 in a secondary tank area 86, such as with a saddle tank, to be drawn into the main tank area 88 by a fuel transfer line 90. Alternatively, the transfer jet pump 80 may be located in the position of the reservoir jet pump 76 to directly transfer fuel from the secondary tank area 86 and put it into the fuel pump module reservoir 34. The jet pumps 76, 80 operate on the same Venturi principle as is known in the art; that is, as the fuel increases in speed at a nozzle, or jet, within the jet pump, pressure is lowered thereby creating a partial vacuum that draws surrounding fuel into the jet stream.

The fuel tank 16 depicted in FIG. 4 is generally depicted with a main tank area 88 and a secondary tank area 86 as is common with a saddle tank arrangement in some rear wheel drive vehicles. The saddle tank as depicted in FIG. 4 has a through area 92 that may accommodate a driveshaft of a rear wheel drive vehicle. Once fuel is transferred to the main tank area 88 with the transfer jet pump 80, and is drawn into the reservoir 34 by jet pump 76, it may be drawn into the fuel pump 50 in accordance with fuel arrows 94 and 96, through a fuel sock 98. The fuel sock 98 is another filtering device of the fuel pump module.

Figure 5:
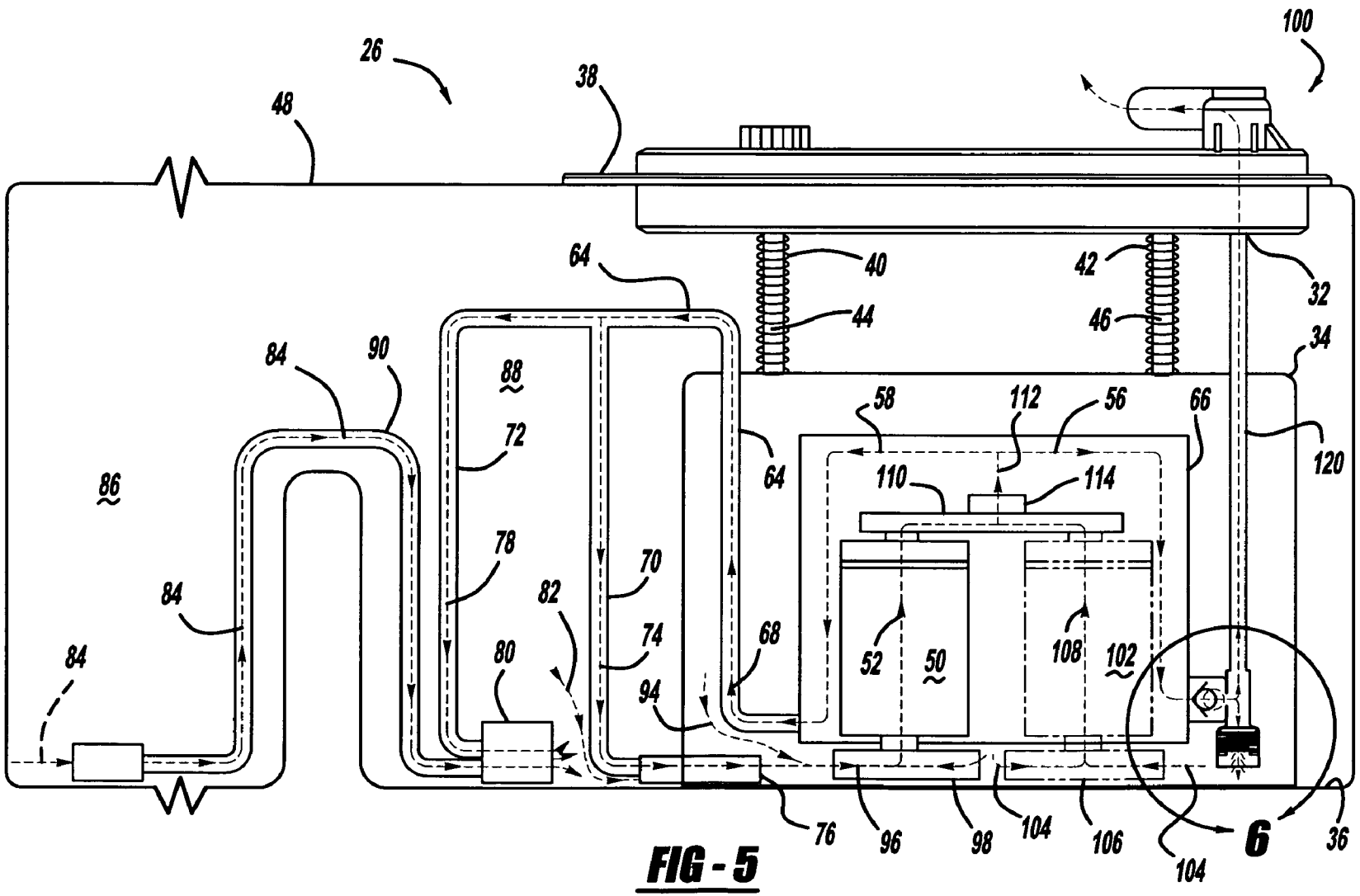
FIG. 5 is a side view of a fuel pump module residing within a fuel tank in accordance with an embodiment of the present invention.

FIG. 5 depicts a second configuration of a fuel pump module 100. More specifically, in the configuration of fuel pump module 100, a second fuel pump 102 is added and draws fuel, in accordance with fuel paths 104, into a second fuel sock 106. Upon receipt of the fuel 104, the second fuel pump 102 pumps the fuel as fuel flow path 108. When the fuel of fuel paths 52 and 108 exits the fuel pumps 50 and 102, respectively, it enters a manifold 110 that combines and blends the fuel flows into a single fuel flow 112 at a manifold exit 114. As in the first configuration of the fuel pump module 30, the fuel flow exiting the fuel pumps 50, 102 is able to flow 360 degrees from the top of the manifold exit 114 to enter the filter. Again, for ease of reference in the side view of FIG. 5, the fuel flow is depicted as divided into fuel flow path 56 and fuel flow path 58. As in the first configuration, fuel flow path 58 is directed to the jet pump feed line 64, while fuel flow path 56 is directed to the check valve 60 and pressure regulator 62, both of which will now be explained in more detail.

Figure 6:
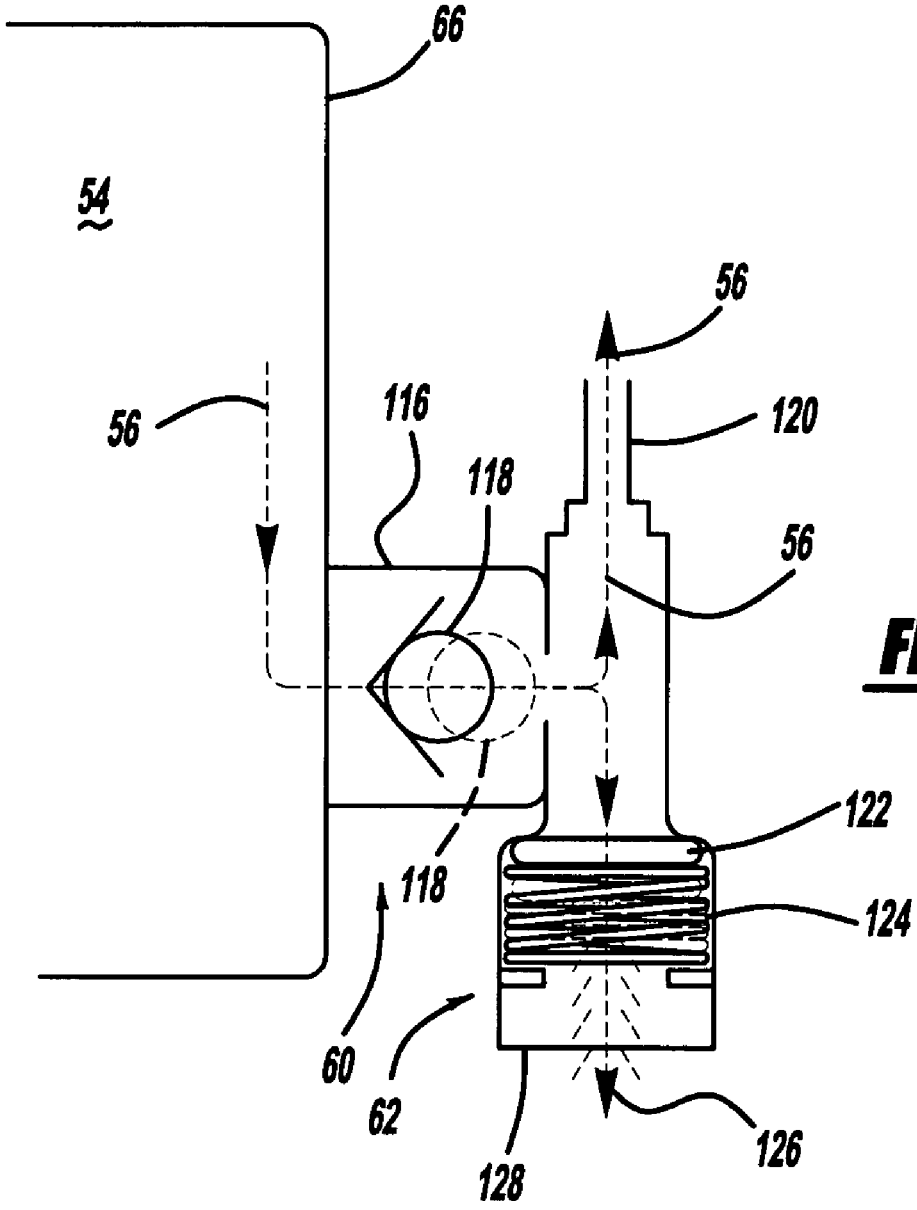
FIG. 6 is an enlarged view of a check valve and pressure regulator depicting their arrangement relative to a fuel filter case in accordance with an embodiment of the present invention.

FIG. 6 depicts an enlarged view of the filter case 66, check valve 60, and pressure regulator 62. More specifically, the check valve 60 is surrounded by a check valve case 116 that may be integrally molded to the filter case 66 in a plastic material, or separately attached to the filter case 66 as a separate component. Likewise, the pressure regulator 62 may be integrally molded to the check valve case 116 as an integral plastic component or separately connected to the check valve case 116. Thus, the combination of the filter case 66, check valve case 116 and pressure regulator 62 may be a single, integrally molded casing or separately assembled using separate components. Continuing, the check valve case 116 houses a check valve 60 generally comprised of a moveable valve element 118. Functionally, when the pressure within the filter case 66 is greater than the pressure on the aft side of the check valve 60, with respect to normal fuel flow conditions, the valve element 118 is in an open position that permits the flow of fuel into the pressure regulator in accordance with flow path 56. When the pressure within the filter case 66 is less than the pressure on the aft side of the check valve 60, the valve element 118 is in a closed position to preserve the pressure in the engine supply line 120.

Continuing with the check valve 60, when the pressure in the filter case 66 is such that the valve element 118 permits fuel to flow to the engine 12, such as when the fuel pump 50 or fuel pumps 50, 102 are operating, fuel flows through the check valve 60 and into the pressure regulator 62, where the fuel flow either continues toward the engine 12 in accordance with fuel flow path 56, or exits the pressure regulator 62 when the fuel pressure at the pressure regulator 62 exceeds a predetermined limit. The pressure at the pressure regulator may exceed the predetermined limit when the fuel pumps 50, 102 create such fuel pressure based on engine demand or during a dead soak event. A dead soak event may occur when the engine is turned off on a hot summer day but the engine compartment and fuel line temperatures continue to rise. Such a rise in temperature with no fuel movement causes the fuel pressure to rise. With the check valve 60 closed, pressure and fuel can not escape into the filter case 66, but instead escapes through the pressure regulator when the pressure forces the pressure plate 122 and spring 124 to move and release fuel and pressure 126 from the pressure regulator 62, such as through the bottom 128 of the pressure regulator 62. If the engine compartment or fuel supply system 20 overheats or a situation is created such that the pressure in the engine supply line 120 is greater than the pressure in the filter case 66, the check valve 60 will close and then fuel may also exit the pressure regulator 62 if the predetermined pressure setting of the pressure regulator is exceeded. In such a situation, fuel pressure is preserved in the engine supply line 120 to aid in instantaneous engine restarting while also alleviating pressures in excess of the pressure regulator setting.

There are many advantages to the teachings of the present invention. The teachings provide placement of a check valve between a fuel filter and a fuel pressure regulator and allow: fuel pressure to remain in the engine supply line 120 when the engine 12 is not operating while also permitting the fuel pressure regulator 62 to relieve fuel pressure when the engine is operating and when the engine is not operating, such as during a dead soak event; the jet pump(s) to operate using sufficiently pressurized and filtered fuel yet disallow the jet pumps to relieve any pressure within the engine supply line 120, that is, pressure within the engine supply line 120 will not escape through the jet pumps 76, 80 and into the fuel tank 16, where a vapor vent valve may permit its release.

Continuing with advantages of the teachings of the present invention, the fuel filter case 66 and accompanying fuel filter 54 possess the ability to accept more than one fuel pump 50, 102 to supply the engine 12 with the required volume flow rate of fuel while maintaining engine supply line pressure between the check valve 60 and the engine 12 after the fuel pump(s) cease operation, such as when the engine 12 is not operating. Another advantage of the present teachings is that the fuel pumps 50, 102 may be manufactured without their own, individual check valves, thus lowering the cost and complexity of the fuel pump. Still yet, another advantage is that a single check valve may be utilized regardless of how many fuel pumps are used within the filter case 66. Such an advantage also decreases part cost and permits a check valve to be repaired or replaced, if necessary, without disposing of or replacing a fuel pump. Still yet, another advantage is that the volume flow rate of fuel to the engine 12 may be increased with an increase in the number of known and existing pumps without designing, as an alternative, a new, larger fuel pump. Such volume flow rate increases may be necessary for applications such as larger engines, higher engine RPMs, or to meet racing performance requirements. Finally, the teachings of the present invention permit the addition of fuel pumps with minimal changes to the surrounding fuel pump module components while maintaining the aforementioned advantages.

What is claimed is:

1. A fuel pump module comprising:
a first fuel pump;
a fuel filter;
a pressure regulator;
a check valve positioned between the fuel filter and the pressure regulator;
a fuel filter case, within which the fuel filter is encased; and
a jet pump feed line inlet attached to an exterior of the fuel filter case to receive fuel directly from the fuel filter.

2. The fuel pump module of claim 1, wherein
the jet pump feed line inlet is attached to an exterior of the fuel filter case to receive fuel from the fuel filter at a fuel pump pumping pressure.

3. The fuel pump module of claim 2, wherein the check valve is attached to an exterior of the fuel filter case.

4. The fuel pump module of claim 3,
wherein the pressure regulator is attached to the fuel filter case.

5. The fuel pump module of claim 1, wherein the first fuel pump supplies fuel in the order of: the fuel filter, the check valve, and then the pressure regulater.

6. The fuel pump module of claim 1, wherein
the jet pump feed line inlet is attached to an exterior of the fuel filter case at a first filter case location, and the check valve is attached to an exterior of the fuel filter case at a second filter case location.

7. A fuel pump module comprising:
a first electric fuel pump;
a second electric fuel pump;
a fuel filter case surrounding the first and second fuel pumps;
a fuel filter within the fuel filter case to receive fuel from the first and second fuel pumps;
a pressure regulator;
a check valve attached to an exterior of the fuel filter case at a first location, between the fuel filter case and the pressure regulator; and
a jet pump feed line inlet attached to an exterior of the fuel filter case at a second location to receive fuel directly from the fuel filter.

8. The fuel pump module of claim 7, further comprising:
a manifold to channel fuel from the first and second pumps into a single manifold outlet.

9. The fuel pump module of claim 7, wherein the pressure regulator is attached to the check valve.

10. The fuel pump module of claim 7, wherein the first and second fuel pumps supply fuel in the order of: the fuel filter, the check valve, and then the pressure regulator.

11. A fuel pump module comprising:
a first electric fuel pump;
a second electric fuel pump;
a manifold, with a first inlet from the first electric fuel pump and a second inlet from the second electric fuel pump that blends fuel from the first and second fuel pumps and discharges fuel from a single outlet;
a fuel filter case;
a fuel filter within the fuel filter case to receive fuel from the first and second fuel pumps;
a check valve attached to the fuel filter case at a first location; and
a pressure regulator attached to the check valve.

12. The fuel pump module of claim 11, further comprising:
an engine supply line that receives fuel from the pressure regulator.

13. The fuel pump module of claim 11, wherein the fuel filter surrounds the first and second fuel pumps.

14. The fuel pump module of claim 11, further corn p rising:
a jet pump feed line inlet attached to the fuel filter case at a second location.

15. The fuel pump module of claim 11, wherein the fuel filter within the fuel filter case receives fuel from the first and second fuel pumps via the single outlet of the manifold.

* * * * *

UNITED STATES PATENT AND TRADEMARK OFFICE

CERTIFICATE OF CORRECTION

PATENT NO. : 7,506,636 B2
APPLICATION NO. : 11/703046
DATED : March 24, 2009
INVENTOR(S) : Joseph Lubinski et al.

It is certified that error appears in the above-identified patent and that said Letters Patent is hereby corrected as shown below:

On The Title Page and Col. 1, line 1, Title Item (54), “VALUE” should be --VALVE--

Col. 6, lines 58-59, claim 14, “corn p rising” should be --comprising--

Signed and Sealed this

Twenty-first Day of July, 2009

John Doll

JOHN DOLL
*Acting Director of the United States Patent and Trademark Office*